US011801878B2

(12) United States Patent
Cowen

(10) Patent No.: US 11,801,878 B2
(45) Date of Patent: Oct. 31, 2023

(54) SENSOR UNIT FOR DETECTING THE APPROACH OF A TRAIN AND SYSTEM WITH SAID SENSOR UNIT

(71) Applicant: Siemens Mobility Limited, London (GB)

(72) Inventor: David Cowen, Chippenham (GB)

(73) Assignee: Siemens Mobility Limited, London (GB)

( * ) Notice: Subject to any disclaimer, the term of this patent is extended or adjusted under 35 U.S.C. 154(b) by 544 days.

(21) Appl. No.: 16/982,553

(22) PCT Filed: Feb. 11, 2019

(86) PCT No.: PCT/EP2019/053306
§ 371 (c)(1),
(2) Date: Sep. 19, 2020

(87) PCT Pub. No.: WO2019/179696
PCT Pub. Date: Sep. 26, 2019

(65) Prior Publication Data

US 2021/0001900 A1 Jan. 7, 2021

(30) Foreign Application Priority Data

Mar. 22, 2018 (GB) ..... 1804567

(51) Int. Cl.
*G08G 1/00* (2006.01)
*G01H 9/00* (2006.01)
(Continued)

(52) U.S. Cl.
CPC ..... *B61L 1/165* (2013.01); *B61L 29/228* (2013.01)

(58) Field of Classification Search
CPC ..... B61L 1/165; B61L 29/228; B61L 29/22; B61L 1/163; B61L 1/169; B61L 23/26; B61L 25/025; B61L 29/28
(Continued)

(56) References Cited

U.S. PATENT DOCUMENTS 6,323,785 B1 11/2001 Nickell et al.
2012/0325979 A1 12/2012 Yoon
(Continued)

FOREIGN PATENT DOCUMENTS

CA 2988569 A1 * 12/2016 ..... F02D 35/027
CN 207739214 U * 8/2018
(Continued)

OTHER PUBLICATIONS

PCT International Search Report and Written Opinion of International Searching Authority dated Feb. 26, 2020 corresponding to PCT International Application No. PCT/EP2019/053306 filed Feb. 11, 2019.

*Primary Examiner* — Tanmay K Shah
(74) *Attorney, Agent, or Firm* — Wolter Van Dyke Davis, PLLC

(57) ABSTRACT

A sensor unit for detecting the approach of a train, the sensor unit having first and second non-rail-mounted sensors, wherein the non-rail-mounted sensors are different from one another. A first control unit, itself having first and second non-rail-mounted sensors, wherein the non-rail-mounted sensors are different from one another in that they work on different physical principles, wherein the first sensor unit and first control unit are arranged to cooperate with one another to detect the approach of a train.

12 Claims, 3 Drawing Sheets

(51) Int. Cl.
*B61L 1/16* (2006.01)
*B61L 29/22* (2006.01)

(58) Field of Classification Search
USPC ..... 340/933
See application file for complete search history.

(56) References Cited

U.S. PATENT DOCUMENTS

| | | | | |
|---|---|---|---|---|
| 2016/0200334 | A1 | 7/2016 | Hilleary | |
| 2017/0088046 | A1 | 3/2017 | Denny et al. | |
| 2017/0313331 | A1* | 11/2017 | Hilleary | B61L 17/02 |
| 2017/0320507 | A1 | 11/2017 | Denny et al. | |

FOREIGN PATENT DOCUMENTS

| | | | |
|---|---|---|---|
| EP | 2846172 | A1 | 3/2015 |
| EP | 3281840 | A2 | 2/2018 |
| WO | 2011162605 | A2 | 12/2011 |

* cited by examiner

SENSOR UNIT FOR DETECTING THE APPROACH OF A TRAIN AND SYSTEM WITH SAID SENSOR UNIT

CROSS REFERENCE TO RELATED APPLICATIONS

This application is the US National Stage of International Application No. PCT/EP2019/053306 filed 11 Feb. 2019, and claims the benefit thereof. The International Application claims the benefit of United Kingdom Application No. GB 1804567.4 filed 22 Mar. 2018. All of the applications are incorporated by reference herein in their entirety.

FIELD OF INVENTION

The present disclosure relates to a sensor unit for detecting the approach of a train. The present disclosure also relates to systems for detecting approach of a train, comprising a sensor unit and a control unit, and further relates to associated methods.

BACKGROUND

For automatic operation of railway crossing systems, some way of detecting an approaching train on the line is needed. Such crossing systems typically have two sensor units, one in each direction from the crossing, communicating with a crossing controller. The sensor units are arranged to detect trains approaching the crossing and to communicate with the crossing control unit so that the crossing controller can sound a warning, illuminate stop lights etc.

Historically rail-mounted sensors such as axle-counter heads have been used for the sensor units, as these have a high reliability. This reliability comes with the increased installation and maintenance costs inherent with any rail-mounted equipment. Alternative sensors that use radar or laser range finding to detect approaching trains have been employed. However, these may suffer from a lack of reliability as they are reliant on line of sight with an approaching train. Misalignment of the sensor with the line, atmospheric effects or masking of an approaching train by a receding train on an adjacent line can all lead to problems, and systems using these non-rail-mounted sensors have thus not been able to demonstrate high safety integrity levels.

Hence an improved sensor unit, control unit and methods of operating such units in a system for detecting the approach of a train are desirable.

SUMMARY

According to the present disclosure there are provided apparatus and methods as set forth in the appended claims. Other features of the invention will be apparent from the dependent claims, and the description which follows.

Accordingly there is provided a sensor unit for detecting the approach of a train, the sensor unit comprising first and second non-rail-mounted sensors, characterised in that the non-rail-mounted sensors are different from one another.

In this way the sensor unit has built in redundancy, with certain common mode failures that might affect detection performance eliminated to thereby increase reliability without the expense of a rail-mounted sensor.

In one example the first non-rail-mounted sensor is a vibration detector. In one example the first non-rail-mounted sensor comprises an accelerometer.

Vibration detectors are not susceptible to key known failure modes of known radar sensors when used line-side for train detection.

In one example the first non-rail-mounted sensor is arranged with a signal processor operable to identify the vibration signature of a train. In one example the first non-rail-mounted sensor is arranged with a signal processor operable to identify the vibration signature of more than one train in a detected vibration, according to different amplitude rise times in the detected vibration.

Low cost signal processing capability is readily available to give an accurate interpretation of vibration sensors, with high reliability and a low rate of false positives even when two or more trains on adjacent lines are approaching.

In one example the second non-rail-mounted sensor is a line of sight sensor. In one example the line of sight sensor is selected from a group comprising: a radar, a Doppler radar, a laser range finder, a LIDAR sensor, and IR sensor, a photographic processing sensor.

In one example the sensor unit comprises a housing, and the first non-rail-mounted sensor and second non-rail-mounted sensor are separately mounted to the housing.

In one example the first non-rail-mounted sensor and second non-rail-mounted sensor are independently mounted to a housing of the sensor unit. In one example the first non-rail-mounted sensor is located internally of a housing, for example being integral with the housing. In one example the first non-rail-mounted sensor is mounted at or near the level of the base of the housing, for example to be at or near ground level when the housing is installed line-side as part of a system for detecting the approach of a train. In one example the second non-rail-mounted sensor is located external to a housing. In one example the second non-rail-mounted sensor is mounted on a pole associated with the housing, so as to be above ground level when the housing is installed line-side as part of a system for detecting the approach of a train.

Physical separation of the first and second non-rail-mounted sensors serves as a further method to reduce the instance of a double failure, for example a pole mounted second non-rail-mounted sensor that is mounted on a pole may be rendered inoperative if the pole is dislodged from position, whereas a first non-rail-mounted sensor within the housing is protected by the housing and may still operate even is the housing is moved or damaged externally.

A system for detecting the approach of a train, the system comprising a first sensor unit according, and a first control unit, wherein the first sensor unit and first control unit are arranged to cooperate with one another to detect the approach of a train.

In one example the first sensor unit is as described in an example aspect above. In one example the first control unit comprises a sensor unit as described in an example aspect above. Using the same basic architecture for the sensor unit and control unit simplifies production and installation of the system, for example on a modular basis.

In one example the system is arranged to generate sensor information at first and second non-rail-mounted sensors of the first sensor unit, to compare the generated sensor information of the first and second non-rail-mounted sensors, and in the event of disagreement between the generated sensor information to use additional sensor information from the first control unit to confirm detection of approach of a train.

By provision of further non-rail-mounted sensors in the control unit, redundancy is further enhanced both in terms of additional sensor capability, and in terms of physical separation.

In one example the system is arranged to use additional sensor information from only the vibration sensor of the first control unit to confirm detection of approach of a train, in the event of disagreement between the generated sensor information of the first sensor unit.

In one example the first sensor unit and first control unit are arranged to detect approach of a train from a first direction.

In one example the system comprises a second sensor unit according, and a second control unit arranged to cooperate with one another to detect the approach of a train from a second direction. In one example the second sensor unit and/or second control unit are as described in an example aspect above.

In one example the first sensor unit is installed in the system at a position that is physically separate from the first control unit. In one example the first control unit is arranged proximate to a line crossing point, and the first sensor unit is arranged remote from the first control unit, along the line in a first direction. In one example the first sensor unit is arranged to communicate with the first control unit, for example wirelessly.

In one example the second sensor unit is installed in the system at a position that is physically separate from the second control unit. In one example the second control unit is arranged proximate to a line crossing point, and the second sensor unit is arranged remote from the first control unit, along the line in a second direction. In one example the second sensor unit is arranged to communicate with the second control unit, for example wirelessly.

In one example the second direction is different to the first direction. In one example the first and second directions are opposite to one another. In one example the first direction is an incoming direction on a first line. In one example the second direction is an incoming direction on a second line.

In one example the first sensor unit and first control unit are arranged to operate substantially independently from the second sensor unit and second control unit, for example as independent units for detecting the approach of a train on first and second lines. In another example the first and second control units may share at least one, for example two, three or more functional elements, for example selected from the group: a housing, a first non-rail-mounted sensor, a communication unit, a data logger, a diagnostic unit, a controller, a power supply, a signal processor, an audio sounder, an optical warning unit.

In one example the system is arranged to generate an alarm in response to detecting the approach of a train, for example an audio warning, or an optical warning such as lighting up a sign or switching of a display from an indication that it is safe to proceed to an indication that it is not safe to proceed. In one example the alarm is for a crossing, for example the alarm is a pedestrian crossing alarm.

A method for detecting the approach of a train, the method comprising: generating sensor information at a sensor unit that comprises first and second non-rail-mounted sensors that are different from one another; comparing the generated sensor information of the first and second non-rail-mounted sensors, and in the event of disagreement between the generated sensor information, using additional sensor information from a control unit to confirm detection of approach of a train.

In one example the generating comprises generating vibrations sensor information and line of sight sensor information at the sensor unit.

In one example the method comprises using additional sensor information from a vibration sensor of the control unit to confirm detection of approach of a train, in the event of disagreement between the generated sensor information from the sensor unit.

In one example the method comprises using only additional sensor information from a vibration sensor of the control unit to confirm detection of approach of a train in the event of disagreement between the generated sensor information from the sensor unit.

In one example the method further comprises generating an alarm in response to detecting the approach of a train.

BRIEF DESCRIPTION OF THE DRAWINGS

Examples of the present disclosure will now be described with reference to the accompanying drawings, in which.

DETAILED DESCRIPTION

Figure 1:
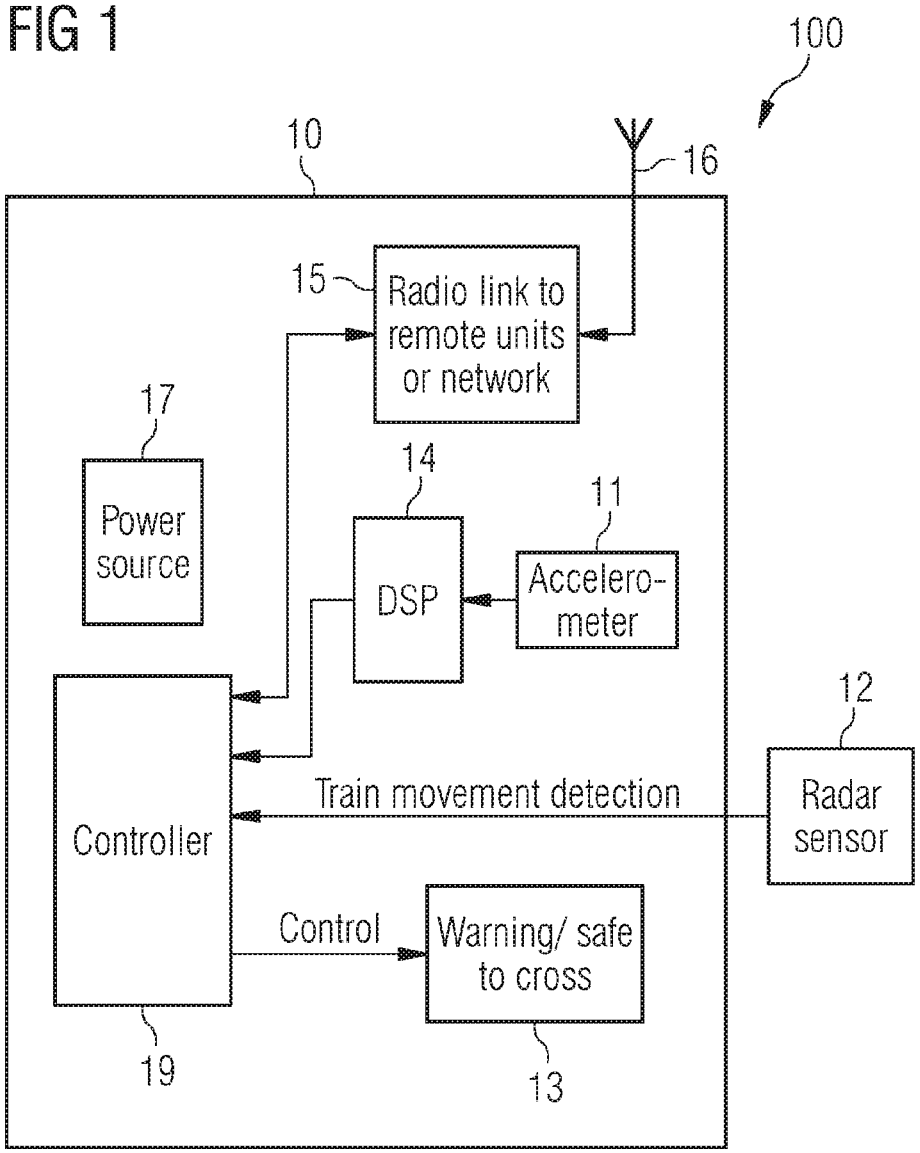
FIG. 1 shows a schematic overview of sensor unit according to an example embodiment.

FIG. 1 shows a schematic overview of sensor unit 100 according to an example embodiment. The sensor unit 100 comprises a housing 10, within which is a first non-rail-mounted sensor 11, and outside of which is a second non-rail-mounted sensor 12. The sensor unit 100 is intended for use within a railway crossing system as described in more detail below, principally for pedestrian or other minor crossings, which are required to operate at a high safety integrity level, but where cost constraints for installation and maintenance are also high.

Significantly, the first and second non-rail-mounted sensors 11, 12 are different from one another to thereby give the sensor unit 100 built in redundancy. In the embodiment of FIG. 1, the first non-rail-mounted sensor 11 is a vibration detector comprising an accelerometer, and the second non-rail-mounted sensor 12 is a Doppler radar sensor. By using different sensor types, in this case different sensors that work on different physical principles, certain common mode failures that might affect detection performance are eliminated thereby increasing reliability without the expense of a rail-mounted sensor.

The sensor unit 100 comprises a digital signal processor 14 that receives the output of the first non-rail-mounted sensor 11 and operates to identify the vibration signature of a train in said output. In fact, the signal processor 14 may further operate to identify the vibration signature of more than one train in the detected vibration signal received as output from the first non-rail-mounted sensor 11, according to different amplitude rise times in the signal.

The first non-rail-mounted sensor 11 is mounted near the level of a base of the housing 10, which in a typical installation will be at or near ground level line-side, as part of a system for detecting the approach of a train. Contrastingly, the same housing 10 also comprises an associated pole for supporting the second non-rail-mounted sensor 12 on the housing, so as to be above ground level when installed line-side. The pole mounted second non-rail-mounted sensor 12 can operate in a normal manner, and even if the pole or other part of the housing is dislodged from its installation position the first non-rail-mounted sensor 11 is likely to still be able to provide an output indicating that vibrations of an approaching train have been sensed.

To facilitate use of the sensor unit 100 in a railway crossing system further components are provided. A power source 17 is used to deliver power to the components of the sensor unit, and may suitably comprise a mains power connection, or a battery connection with or without a supplementary renewable source for charging. Communication is provided by a communication unit in the form of radio interface 15 and aerial 16, although it will be appreciated that wired or other communications units may alternatively be provided so that the sensor unit 100 can participate in information transfer between itself and other elements of a railway crossing system in use. The controller 19 is arranged to control proper operation of the other components, including a warning generator 13 that can be operated according to whether or not a train is detected by the first and second non-rail-mounted sensors 11, 12.

Figure 2:
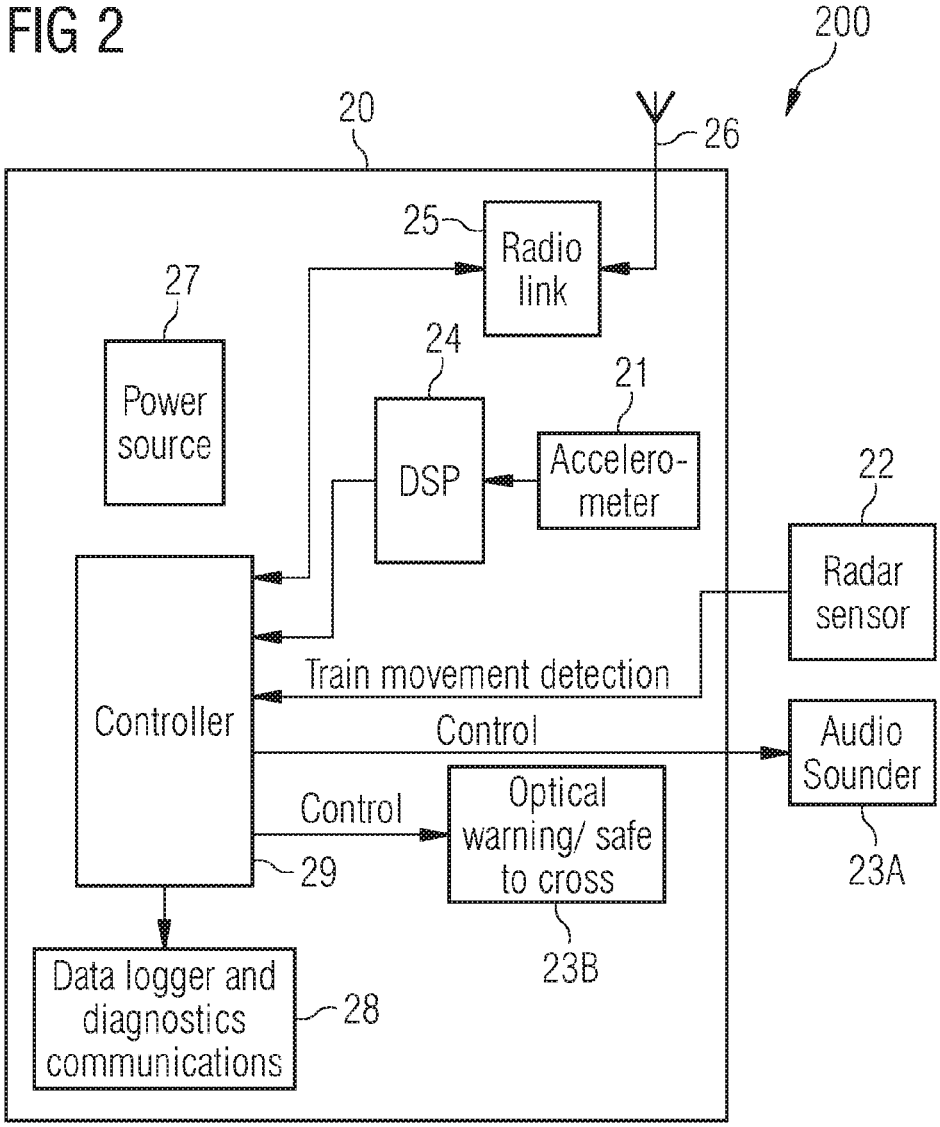
FIG. 2 shows a schematic overview of a control unit according to an example embodiment.

FIG. 2 shows a schematic overview of control unit 200 according to an example embodiment. The control unit 200 generally corresponds to the sensor unit 100, and comprises: first and second non-rail-mounted sensors 21, 22, a warning generator made up of an audio sounder 23A and an optical warning unit 23B, a digital signal processor 24, a communication unit in the form of radio interface 25 and aerial 26, a power source 27, a data logger/diagnostic unit 28 and a controller 29. Using the same basic architecture for the sensor unit 100 and control unit 200 simplifies production and installation of the system, for example on a modular basis.

Figure 3:
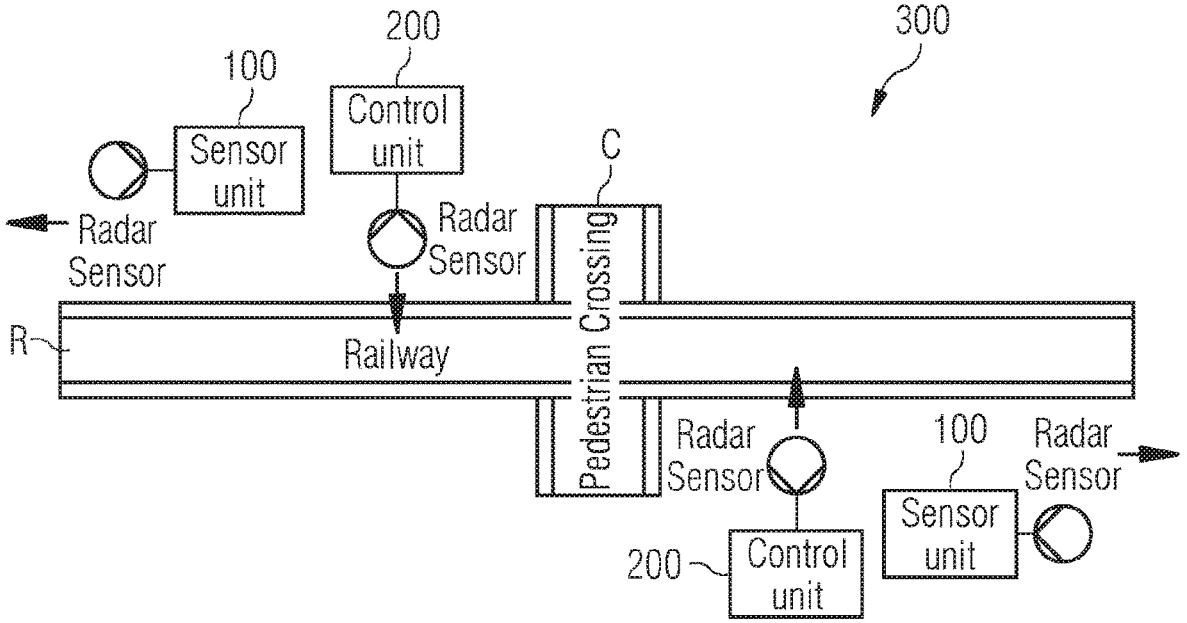
FIG. 3 shows a schematic overview of sensor units and control units as part of a railway crossing, in a system according to an example embodiment.

FIG. 3 shows a schematic overview of sensor units 100 and control units 200 as part of a railway crossing C. A sensor unit 100 and a control unit 200 comprise parts of a system 300 for detecting the approach of a train on the railway R. The system 300 comprises a first sensor unit 100 and a first control unit 200 arranged to cooperate with one another to detect the approach of a train in one direction, for example from the left of FIG. 3 on the line of the railway R that is shown toward the top of FIG. 3. Corresponding features are provided in the line of the railway R that is shown toward the bottom of FIG. 3 in order to detect the approach of a train from the right of FIG. 3 on this line.

The Doppler radar sensors of the sensor units 100 and control units 200 and serve as main means of detecting approach of a train toward the crossing system 300, but supplemented with the accelerometers of the sensor units 100 and control units 200. The accelerometers' main function is to detect the vibration signature of an approaching train and to indicate to the respective controller 19, 29 that the Doppler radar sensors should be detecting movement. This increases the safety integrity of the system 300 for detecting the approach of a train, as it effectively provides an indication that the Doppler radar sensor should be seeing something and hence provides a system self-test, but at a much reduced cost and power consumption compared to duplicating Doppler radar sensors in order to provide redundancy. The accelerometers in each sensor unit 100 and control unit 200 can be mounted in the respective housings 10, 20, to picking up the vibration of an approaching train via the ground, housing, and mounting. In this way certain common mode failures that may affect systems with two Doppler radar sensors, for example twisting of a mounting pole due to wind damage and thus sensor misalignment for duplicated sensors on the pole, are overcome.

When a train approaches the sensor unit 100, in normal operation the Doppler radar and accelerometer would sense the movement, and the controller 19 passes information to the control unit 200 to allow a suitable warning to be generated, either audio and/or optical for the crossing user, at any of the sensor/control units 100, 200 using their associated warning generators.

If the approach of a train is detected by the accelerometer but not by the Doppler radar of the sensor unit 100, a disagreement message is generated by the controller 19 communicated to the control unit 200. The control unit 200 can then decide whether to cause a warning to be generated for crossing users even without the detection signal from the radar. In making the decision, the control unit 200 may take into consideration sensor information from its own accelerometer and/or Doppler radar. In addition, or alternatively the control unit 200 may take into consideration sensor information from the other remote sensor 100 and/or the other control unit 200.

For example, if the control unit 200 has detected a train coming past the crossing C, it can surmise that the Doppler radar sensor at the point the train passes next will not be detected by the radar, since the Doppler radar sensors are set up in these applications to detect only traffic approaching the area of interest. If the control unit has not seen a train go past it, it can determine that the signal from the accelerometer is likely to correspond to the approach of a real train and generate a warning.

Figure 4:
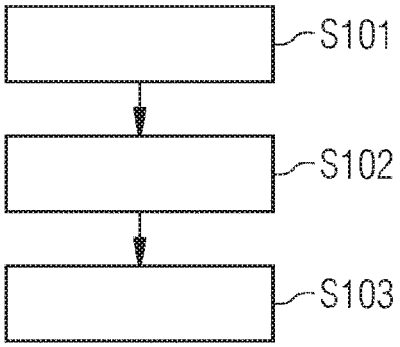
FIG. 4 shows a schematic flow diagram of a method of detecting the approach of a train according to an example embodiment.

FIG. 4 shows schematic flow diagram of a method of detecting the approach of a train according to an example embodiment. At step S101 the method comprises generating sensor information at a sensor unit that comprises first and second non-rail-mounted sensors that are different from one another. At step S102 the method comprises comparing the generated sensor information of the first and second non-rail-mounted sensors. At step S103, in the event of disagreement between the generated sensor information, the method further comprises using additional sensor information from a control unit to confirm detection of approach of a train. In another embodiment the method may further comprise generating an alarm in response to detecting the approach of a train.

As described, the example embodiments offer a low cost alternative to known rail-mounted sensors for detecting approach of a train. The embodiments can be readily implemented in a way which provides multiple degrees of redundancy in individual units, and across a crossing system by use of common sensor operation and logic across units.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A system for detecting the approach of a train, the system comprising:

a first sensor unit for detecting the approach of a train, the first sensor unit comprising first (11) and second (12) non-rail-mounted sensors, wherein the first (11) and second (12) non-rail-mounted sensors are different from one another in that they work on different physical principles, and a first control unit, itself comprising first (21) and second (22) non-rail-mounted sensors, wherein the first (21) and second (22) non-rail-mounted sensors are different from one another in that they work on different physical principles, wherein the first sensor unit and first control unit are arranged to cooperate with one another to detect the approach of a train, the system being arranged to generate sensor information at first (11) and second (12) non-rail-mounted sensors of the first sensor unit, to compare the generated sensor information of the first (11) and second (12) non-rail-mounted sensors of the first sensor unit, and in the event of disagreement between the generated sensor information of the first (11) and second (12) non-rail-mounted sensors the of the first sensor unit, to use additional sensor information from the first control unit to confirm detection of approach of a train.

2. The system of claim 1, wherein each of the first (11) non-rail-mounted sensor of the sensor unit and the first (21) non-rail-mounted sensor of the control unit is a vibration detector.

3. The system of claim 2, further comprising:

a signal processor operable to identify the vibration signature of more than one train in a detected vibration, according to different amplitude rise times in the detected vibration.

4. The system of claim 1, wherein each of the second (12) non-rail-mounted sensor of the sensor unit and the second (22) non-rail-mounted sensor of the control unit is a line of sight sensor.

5. The system of claim 1, wherein the first (11) non-rail-mounted sensor of the sensor unit and the second (12) non-rail-mounted sensor of the sensor unit are separately mounted to a housing of the sensor unit.

6. The system of claim 2, arranged to use additional sensor information from only the vibration detector (21) of the first control unit to confirm detection of approach of a train, in the event of disagreement between the generated sensor information of the first sensor unit.

7. The system of claim 1, wherein the first sensor unit and first control unit are arranged to detect approach of a train from a first direction.

8. The system of claim 1, further comprising:

a second sensor unit for detecting the approach of a train, the second sensor unit comprising first and second non-rail-mounted sensors, wherein the non-rail-mounted sensors are different from one another in that they work on different physical principles, and a second control unit itself comprising first and second non-rail-mounted sensors, wherein the non-rail-mounted sensors are different from one another in that they work on different physical principles, arranged to cooperate with one another to detect the approach of a train from a second direction.

9. A method for detecting the approach of a train, the method comprising:

generating sensor information at a sensor unit that comprises first (11) and second (12) non-rail-mounted sensors that are different from one another in that they work on different physical principles;

comparing the generated sensor information of the first (11) and second (12) non-rail-mounted sensors, and in the event of disagreement between the generated sensor information, using additional sensor information from a control unit to confirm detection of approach of a train; wherein the control unit, itself comprising first (21) and second (22) non-rail-mounted sensors, wherein the first (21) and second (22) non-rail-mounted sensors are different from one another in that they work on different physical principles, wherein the sensor unit and control unit are arranged to cooperate with one another to detect the approach of a train.

10. The method of claim 9, wherein the generating sensor information comprises generating vibration sensor information and line of sight sensor information at the sensor unit.

11. The method of claim 9, further comprising:

using additional sensor information from a vibration sensor of the control unit to confirm detection of approach of a train, in the event of disagreement between the generated sensor information from the sensor unit.

12. The method of claim 9, further comprising:

generating an alarm in response to detecting the approach of a train.

* * * * *